US011047388B2

(12) United States Patent
Ueno

(10) Patent No.: US 11,047,388 B2
(45) Date of Patent: Jun. 29, 2021

(54) SINGLE-SCREW COMPRESSOR

(71) Applicant: DAIKIN INDUSTRIES, LTD., Osaka (JP)

(72) Inventor: Hiromichi Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 198 days.

(21) Appl. No.: 16/481,375

(22) PCT Filed: Dec. 27, 2017

(86) PCT No.: PCT/JP2017/046975
§ 371 (c)(1),
(2) Date: Jul. 26, 2019

(87) PCT Pub. No.: WO2018/139161
PCT Pub. Date: Aug. 2, 2018

(65) Prior Publication Data

US 2020/0003212 A1 Jan. 2, 2020

(30) Foreign Application Priority Data

Jan. 30, 2017 (JP) ..... JP2017-014081

(51) Int. Cl.
*F04C 18/52* (2006.01)
*F04C 27/00* (2006.01)

(52) U.S. Cl.
CPC ..... *F04C 18/52* (2013.01); *F04C 27/004* (2013.01)

(58) Field of Classification Search
CPC ..... F04C 18/52; F04C 27/004
See application file for complete search history.

(56) References Cited

U.S. PATENT DOCUMENTS

2012/0009079 A1* 1/2012 Hossain ..... F04C 18/52 418/201.1

FOREIGN PATENT DOCUMENTS

JP 2010-1873 A 1/2010

OTHER PUBLICATIONS

European Search Report of corresponding EP Application No. 17 89 3652.2 dated May 29, 2020.
International Search Report of corresponding PCT Application No. PCT/JP2017/046975 dated Apr. 3, 2018.
International Preliminary Report of corresponding PCT Application No. PCT/JP2017/046975 dated Aug. 8, 2019.

* cited by examiner

*Primary Examiner* — Mary Davis
(74) *Attorney, Agent, or Firm* — Global IP Counselors, LLP

(57) ABSTRACT

A single-screw compressor includes a screw rotor with helical grooves, a gate rotor assembly including first and second gate rotors, and a casing housing the screw rotor and the gate rotor assembly. A rotor support member is attached to the first and second gate rotor rotors, and is rotatably supported by the casing. Each of the helical grooves of the screw rotor has a front sidewall surface and a rear sidewall surface. Each of the gates of the first gate rotor slides only on the front sidewall surface of the helical groove in which the gate has entered. Each of the gates of the second gate rotor slides only on the rear sidewall surface of the helical groove in which the gate has entered. The first and second gate rotors of the gate rotor assembly are coaxially arranged and relatively displaceable in a circumferential direction.

9 Claims, 11 Drawing Sheets

SINGLE-SCREW COMPRESSOR

CROSS-REFERENCE TO RELATED APPLICATIONS

This U.S. National stage application claims priority under 35 U.S.C. § 119(a) to Japanese Patent Application No. 2017-014081, filed in Japan on Jan. 30, 2017, the entire contents of which are hereby incorporated herein by reference.

BACKGROUND

Field of the Invention

The present invention relates to a single-screw compressor for compressing fluid.

Background Information

A single-screw compressor has been used as a compressor for compressing fluid. For example, Japanese Unexamined Patent Publication No. 2010-001873 discloses a single-screw compressor including a single screw rotor and two gate rotor assemblies.

The single-screw compressor includes a plurality of helical grooves formed in the screw rotor, and each of the gate rotor assemblies has a plurality of gates radially arranged on a gate rotor. In this single-screw compressor, the screw rotor and the gate rotor assemblies mesh with each other, and each of the gates of the gate rotors enters an associated one of the helical grooves of the screw rotor, thereby forming a compression chamber. When the screw rotor is driven to rotate by an electric motor or the like, the gate rotor assemblies meshing with the screw rotor rotate. Then, each of the gates of the gate rotor relatively moves from a starting end to terminal end of the corresponding helical groove in which the gate has entered, thereby compressing the fluid sucked into the compression chamber.

SUMMARY

The conventional single-screw compressor includes a single gate rotor provided for the gate rotor assemblies, and the gate of the gate rotor slides on the wall surface of the helical groove, thereby keeping the compression chamber gastight. During the operation of the single-screw compressor, the temperature of the gate rotor increases, which causes the gate rotor to thermally expand. When the gate rotor thermally expands to increase the width of the gates, each gate widened through the thermal expansion is strongly pressed against the wall surface of the corresponding helical groove, resulting in the increase in the wear amount of the gate. When the gate is worn, the compression chamber becomes less gastight, and the performance of the compressor decreases.

In view of the foregoing, it is an object of the present invention to reduce the decrease in the performance of a single-screw compressor by reducing the wear of the gates caused by thermal expansion of the gate rotor.

A first aspect of the present disclosure is directed to a single-screw compressor including: a screw rotor (40) provided with helical grooves (41); a gate rotor assembly (50) meshing with the screw rotor (40); and a casing (10) housing the screw rotor (40) and the gate rotor assembly (50). The gate rotor assembly (50) includes: a first gate rotor (60) and a second gate rotor (70) each having a plurality of gates (61, 71), each of the gates (61, 71) entering an associated one of the helical grooves (41) of the screw rotor (40) to form a compression chamber (37); and a rotor support member (55) attached to the first gate rotor (60) and the second gate rotor (70) and rotatably supported by the casing (10). Each of the helical grooves (41) of the screw rotor (40) has a front sidewall surface (42) on a front side in a direction of rotation of the screw rotor (40), and a rear sidewall surface (43) on a rear side in the direction of rotation of the screw rotor (40). Each of the gates (61) of the first gate rotor (60) slides only on the front sidewall surface (42), of the front sidewall surface (42) and rear sidewall surface (43) of the associated one of the helical grooves (41) in which the gate (61) has entered. Each of the gates (71) of the second gate rotor (70) slides only on the rear sidewall surface (43), of the front sidewall surface (42) and rear sidewall surface (43) of the helical groove (41) in which the gate (71) has entered. The first gate rotor (60) and second gate rotor (70) of the gate rotor assembly (50) are coaxially arranged and are relatively displaceable in a circumferential direction.

In the first aspect, the gate rotor assembly (50) is provided with the first gate rotor (60) and the second gate rotor (70). The first gate rotor (60) and the second gate rotor (70) are attached to the rotor support member (55). When the screw rotor (40) rotates, the gate rotor assembly (50) meshing with the screw rotor (40) is driven by the screw rotor (40) to rotate.

In the first aspect, each of the first gate rotor (60) and the second gate rotor (70) includes a plurality of gates (61, 71). Each of the gates (61) of the first gate rotor (60) that has entered an associated one of the helical grooves (41) of the screw rotor (40) slides on the front sidewall surface (42) of the helical groove (41) of the screw rotor (40), but does not slide on the rear sidewall surface (43) of the same helical groove (41). In contrast, each of the gates (71) of the second gate rotor (70) that has entered an associated one of the helical grooves (41) of the screw rotor (40) slides on the rear sidewall surface (43) of the helical groove (41) of the screw rotor (40), but does not slide on the front sidewall surface (42) of the same helical groove (41). In the gate rotor assembly (50), each of the gates (61) of the first gate rotor (60) slides on the front sidewall surface (42) of the corresponding helical groove (41) of the screw rotor (40), and each of the gates (71) of the second gate rotor (70) slides on the rear sidewall surface (43) of the corresponding helical groove (41) of the screw rotor (40). This can keep the compression chamber (37) gastight.

When the gate rotor thermally expands, the width of the gates increases. In a general single-screw compressor in which only a single gate rotor is provided for the gate rotor assembly, the gate that has entered the helical groove of the screw rotor slides on both of the front and rear sidewall surfaces of the helical groove. Therefore, when the gate rotor thermally expands to increase the width of the gate, a contact pressure acting on the gate increases, and the gate is worn.

In contrast, in the gate rotor assembly (50) according to the first aspect, the first gate rotor (60) having the gates (61) each of which slides on the front sidewall surface (42) of the helical groove (41) but does not slide on the rear sidewall surface (43), and the second gate rotor (70) having the gates (71) each of which slides on the rear sidewall surface (43) of the helical groove (41) but does not slide on the front sidewall surface (42) are relatively displaceable in the circumferential direction. Therefore, even when the gate rotor (60, 70) thermally expands to increase the width of the gate (61, 71), the relative displacement of the two gate rotors (60, 70) keeps the force received from the sidewall surfaces (42, 43) of the helical groove (41) from increasing, thereby reducing the wear amount of the gate (61, 71).

A second aspect of the present disclosure is an embodiment of the first aspect. In the second aspect, the first gate rotor (60) and second gate rotor (70) of the gate rotor assembly (50) overlap one another such that a front surface (62) of the first gate rotor (60) faces the compression chamber (37), and that the second gate rotor (70) is located closer to a back surface (63) of the second gate rotor (60).

In the gate rotor assembly (50) of the second aspect, the first gate rotor (60) and the second gate rotor (70) overlap one another. The first gate rotor (60) is arranged closer to the compression chamber (37). The second gate rotor (70) is arranged opposite to the compression chamber (37) with respect to the first gate rotor (60).

In the second aspect, the gate (61) of the first gate rotor (60) that has entered an associated one of the helical grooves (41) of the screw rotor (40) does not make contact with the rear sidewall surface (43) of the helical groove (41). Thus, a gap is formed between the gate (61) and the rear sidewall surface (43) of the helical groove (41). Thus, the gate (61) of the first gate rotor (60) which has entered the helical groove (41) of the screw rotor (40) receives the pressure of the compression chamber (37) (i.e., the pressure of the fluid present in the compression chamber (37)) on the lateral face facing the rear sidewall surface (43) of the helical groove (41). As a result, the gate (61) of the first gate rotor (60) that has entered the helical groove (41) of the screw rotor (40) is pushed toward the front sidewall surface (42) of the helical groove (41), and slides on the front sidewall surface (42) of the helical groove (41) with reliability.

A third aspect of the present disclosure is an embodiment of the second aspect. In the third aspect, each of the gates (71) of the second gate rotor (70) has a lateral face facing the rear sidewall surface (43) of the helical groove (41), and an edge of the lateral face toward the first gate rotor (60) serves as a rear seal line (77) which is a linear portion extending in a radial direction of the second gate rotor (70) and slides on the rear sidewall surface (43).

In the gate rotor assembly (50) according to the third aspect, each of the gates (71) of the second gate rotor (70) has a lateral face facing the rear sidewall surface (43) of the helical groove (41) of the screw rotor (40), and an edge of the lateral face toward the first gate rotor (60) serves as the rear seal line (77) which slides on the rear sidewall surface (43). A gap is formed between the gate (71) of the second gate rotor (70) that has entered an associated one of the helical grooves (41) of the screw rotor (40) and the front sidewall surface (42) of the helical groove (41). Thus, the gate (71) of the second gate rotor (70) that has entered the helical groove (41) of the screw rotor (40) receives the same fluid pressure on the entire lateral face facing the front sidewall surface (42) of the helical groove (41) and the entire lateral face facing the rear sidewall surface (43) of the helical groove (41). On the gate (71) of the second gate rotor (70) which has entered the helical groove (41) of the screw rotor (40), the fluid pressure acting on the lateral face facing the front sidewall surface (42) of the helical groove (41) and the fluid pressure acting on the lateral face facing the rear sidewall surface (43) of the helical groove (41) cancel each other out.

A fourth aspect of the present disclosure is an embodiment of the second or third aspect. In the fourth aspect, each of the gates (61) of the first gate rotor (60) has a lateral face facing the front sidewall surface (42) of the helical groove (41), and an edge of the lateral face toward the second gate rotor (70) serves as a front seal line (67) which is a linear portion extending in a radial direction of the first gate rotor (60) and slides on the front sidewall surface (42).

In the fourth aspect, the first gate rotor (60) and the second gate rotor (70) overlap one another, and the first gate rotor (60) is arranged closer to the compression chamber (37). Each of the gates (61) of the first gate rotor (60) has a lateral face facing the front sidewall surface (42) of the helical groove (41) of the screw rotor (40), and an edge of the lateral face toward the second gate rotor (60) serves as the front seal line (67) which slides on the front sidewall surface (42).

As described above, the second gate rotor (70) according to the third aspect has the lateral face facing the rear sidewall surface (43) of the helical groove (41) of the screw rotor (40), and the edge of the lateral face toward the first gate rotor (60) serves as the rear seal line (77) which slides on the rear sidewall surface (43). Therefore, when the third and fourth aspects are combined, the front seal line (67) of the gate (61) of the first gate rotor (60) and the rear seal line (77) of the gate (71) of the second gate rotor (70) are located on substantially the same plane.

A fifth aspect of the present disclosure is an embodiment of any one of the second to fourth aspects. In the fifth aspect, the first gate rotor (60) is thinner than the second gate rotor (70).

As described above, a gap is formed between the gate (61) of the first gate rotor (60) which has entered the helical groove (41) of the screw rotor (40) and the rear sidewall surface (43) of the helical groove (41). Since the first gate rotor (60) is arranged closer to the compression chamber (37), the gap formed between the gate (61) of the first gate rotor (60) and the rear sidewall surface (43) of the helical groove (41) serves as a passage which allows the compression chamber (37) to communicate with the outside of the compression chamber (37). Thus, if the gap is large, the amount of fluid leaking from the compression chamber (37) through this gap increases, which may lead to the decrease in the efficiency of the single-screw compressor.

In contrast, in the gate rotor assembly (50) according to the fifth aspect, the first gate rotor (60) facing the compression chamber (37) is thinner than the first gate rotor (70) arranged on the back surface (63) of the first gate rotor (60). The thinner the first gate rotor (60) is, the narrower the gap formed between the gate (61) of the first gate rotor (60) and the rear sidewall surface (43) of the helical groove (41) becomes. Therefore, when the first gate rotor (60) is made thinner than the second gate rotor (70), the amount of fluid leaking from the compression chamber (37) is reduced, and the performance of the single-screw compressor (1) is kept high.

In the gate rotor assembly (50) according to the first aspect, the first gate rotor (60) having the gates (61) each of which slides on the front sidewall surface (42) of the helical groove (41) but does not slide on the rear sidewall surface (43) and the second gate rotor (70) having the gates (71) each of which slides on the rear sidewall surface (43) of the helical groove (41) but does not slide on the front sidewall surface (42) are relatively displaceable in the circumferential direction. Thus, in this aspect, even when each of the gate rotors (60, 70) thermally expands, the force that the gate (61, 71) receives from the sidewall surfaces (42, 43) of the helical groove (41) can be kept from increasing, thereby reducing the wear amount of the gate (61, 71). Therefore, this aspect can keep the performance of the single-screw compressor (1) from decreasing due to the wear of the gate (61, 71).

In the gate rotor assembly (2) according to the second aspect, the first gate rotor (60) is arranged to face the compression chamber (37), and the second gate rotor (70) is arranged on the back surface (63) of the first gate rotor (60). Thus, the gate (61) of the first gate rotor (60) that has entered the helical groove (41) of the screw rotor (40) can be pressed toward the front sidewall surface (42) of the helical groove (41) by the fluid pressure of the compression chamber (37). This allows the gate (61) to slide on the front sidewall surface (42) of the helical groove (41) with reliability. Therefore, according to this aspect, even when the width of the gate (61, 71) of the gate rotor (60, 70) varies due to thermal expansion or wear, the gate (61) of the first gate rotor (60) slides on the front sidewall surface (42) of the helical groove (41) of the screw rotor (40), thereby ensuring the gastightness of the compression chamber (37).

In the third aspect, each of the gates (71) of the second gate rotor (70) has a lateral face facing the rear sidewall surface (43) of the helical groove (41) of the screw rotor (40), and the edge of the lateral face toward the first gate rotor (60) serves as the rear seal line (77) which makes contact with the rear sidewall surface (43). Thus, on the gate (71) of the second gate rotor (70) which has entered the helical groove (41) of the screw rotor (40), the fluid pressure acting on the lateral face facing the rear sidewall surface (43) of the helical groove (41) (i.e., the fluid pressure acting in the direction in which the gate (71) is separated away from the rear sidewall surface (43) of the helical groove (41)) is canceled by the fluid pressure acting on the lateral face facing the front sidewall surface (42) of the helical groove (41). Thus, in this aspect, the gate (71) of the second gate rotor (70) which has entered the helical groove (41) of the screw rotor (40) can slide on the rear sidewall surface (43) of the helical groove (41) with reliability. This can ensure the gastightness of the compression chamber (37).

In the fifth aspect, the first gate rotor (60) arranged closer to the compression chamber (37) is thinner than the second gate rotor (70) arranged closer to the rotor support member (55). This can narrow the gap formed between the gate (61) of the first gate rotor (60) and the rear sidewall surface (43) of the helical groove (41), and can reduce the amount of fluid leaking from the compression chamber (37) through this gap. Therefore, according to this aspect, the performance of the single-screw compressor (1) can be kept high.

DETAILED DESCRIPTION OF EMBODIMENT(S)

Embodiments of the present invention will be described in detail with reference to the drawings. Note that the following embodiments and variations are merely beneficial examples in nature, and are not intended to limit the scope, applications, or use of the invention.

A single-screw compressor (1) of this embodiment (will be hereinafter simply referred to as a "screw compressor") is provided in a refrigerant circuit of a refrigeration apparatus to compress a refrigerant. That is, the screw compressor (1) of this embodiment sucks and compresses the refrigerant which is fluid.

—Single-Screw Compressor—

Figure 1:
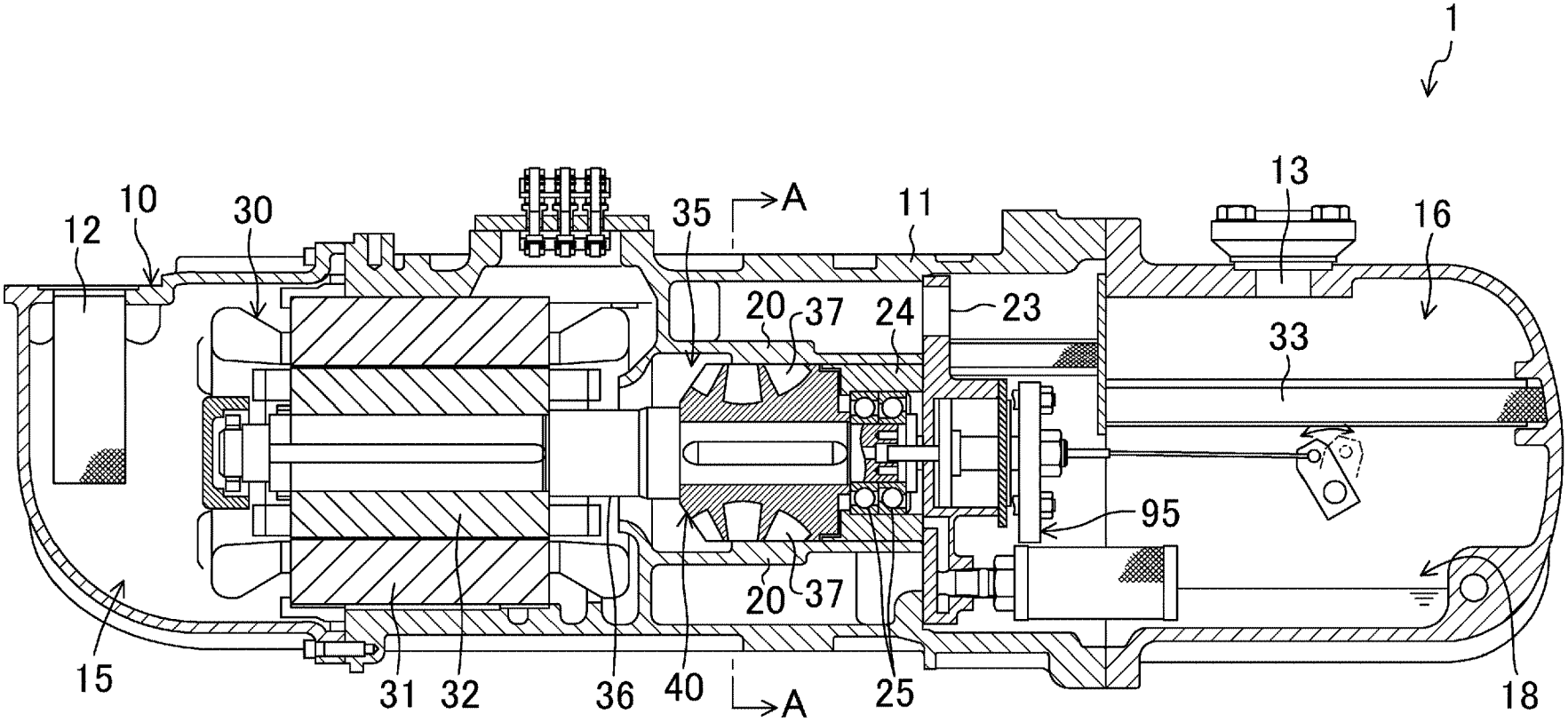
FIG. 1 is a longitudinal cross-sectional view of a single-screw compressor according to an embodiment.

As shown in FIG. 1, in the screw compressor (1), a compression mechanism (35) and an electric motor (30) driving the compression mechanism are housed in a single casing (10). The screw compressor (1) is configured as a semi-hermetic compressor.

The casing (10) includes a body (11) and a cylinder portion (20).

The body (11) is in the shape of a laterally oriented cylinder with both ends closed. An internal space of the body (11) is divided into a low pressure space (15) located at one end of the body (11) and a high pressure space (16) located at the other end of the body (11). The body (11) is provided with a suction port (12) communicating with the low pressure space (15), and a discharge port (13) communicating with the high pressure space (16). A low pressure refrigerant flowing from an evaporator of the refrigeration apparatus flows into the low pressure space (15) through the suction port (12). A high pressure refrigerant compressed and discharged from the compression mechanism (35) to the high pressure space (16) is supplied to a condenser of the refrigeration apparatus through the discharge port (13).

Inside the body (11), the electric motor (30) is arranged in the low pressure space (15), and the compression mechanism (35) is arranged between the low pressure space (15) and the high pressure space (16). The electric motor (30) is disposed between the suction port (12) of the body (11) and the compression mechanism (35). A stator (31) of the electric motor (30) is fixed to the body (11). A rotor (32) of the electric motor (30) is connected to a drive shaft (36) of the compression mechanism (35). When the electric motor (30) is energized, the rotator (32) rotates, and a screw rotor (40) of the compression mechanism (35), which will be described later, is driven by the electric motor (30).

Inside the body (11), an oil separator (33) is disposed in the high pressure space (16). The oil separator (33) separates a refrigerating machine oil from the high pressure refrigerant discharged from the compression mechanism (35). An oil reservoir chamber (18) for storing the refrigerating machine oil, which is a lubricant, is formed in the high pressure space (16) below the oil separator (33). The refrigerating machine oil separated from the refrigerant in the oil separator (33) flows downward and accumulates in the oil reservoir chamber (18).

Figure 2:
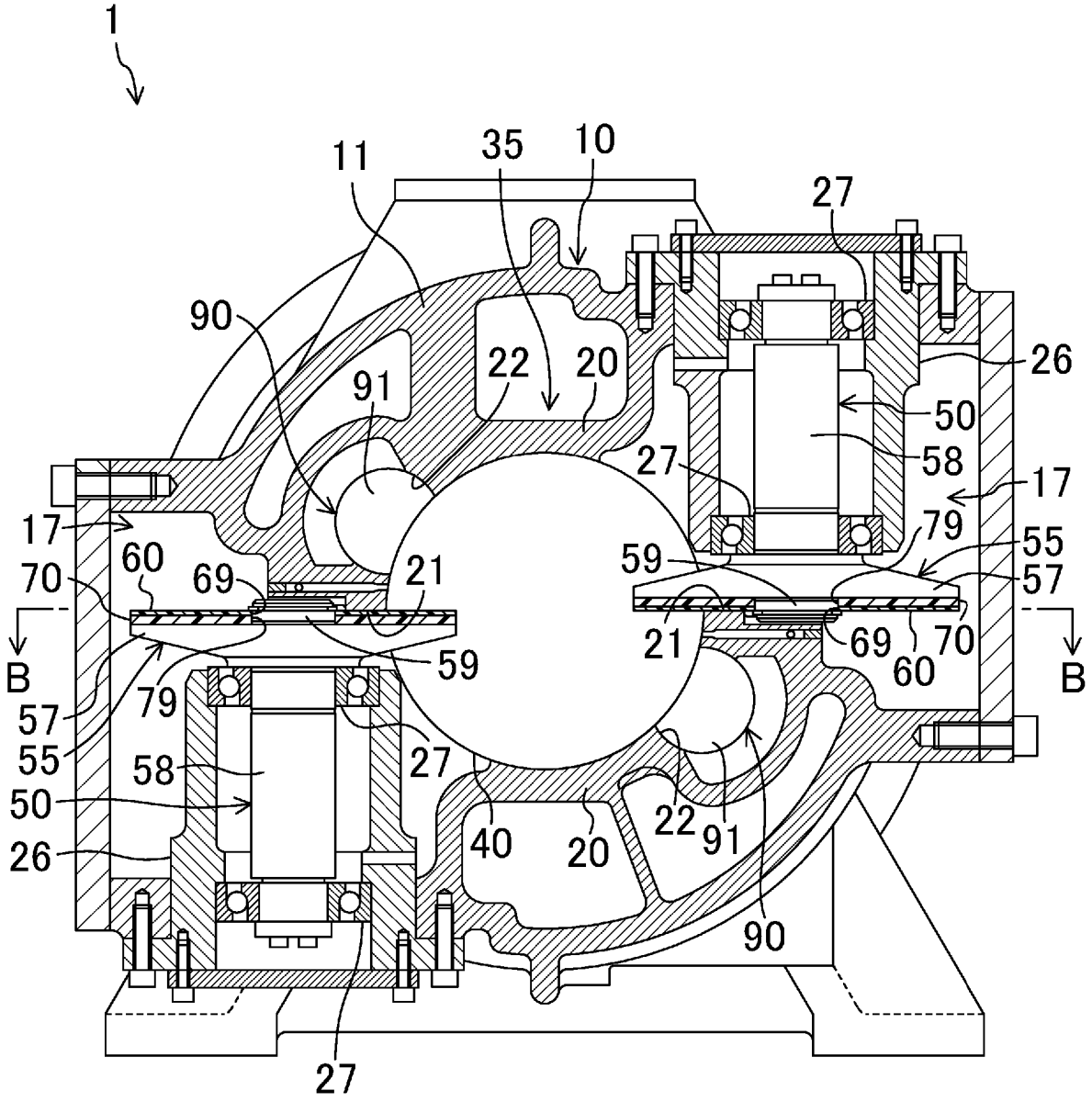
FIG. 2 is a cross-sectional view taken along line A-A in FIG. 1, illustrating a single-screw compressor (1).

As shown in FIGS. 1 and 2, the cylinder portion (20) is substantially cylindrical. The cylinder portion (20) is disposed at a center portion in the longitudinal direction of the body (11), and is integrated with the body (11). An inner peripheral surface of the cylinder portion (20) is a cylindrical surface.

A single screw rotor (40) is inserted in the cylinder portion (20). The drive shaft (36) is coaxially connected to the screw rotor (40). Two gate rotor assemblies (50) mesh with the screw rotor (40). The screw rotor (40) and the gate rotor assemblies (50) constitute the compression mechanism (35).

The casing (10) is provided with a bearing fixing plate (23) serving as a partition wall. The bearing fixing plate (23) is substantially in the shape of a disk, and is disposed to cover an open end of the cylinder portion (20) toward the high pressure space (16). A bearing holder (24) is attached to the bearing fixing plate (23). The bearing holder (24) is fitted in an end portion (an end portion toward the high pressure space (16)) of the cylinder portion (20). A ball bearing (25) for supporting the drive shaft (36) is fitted in the bearing holder (24).

Figure 3:
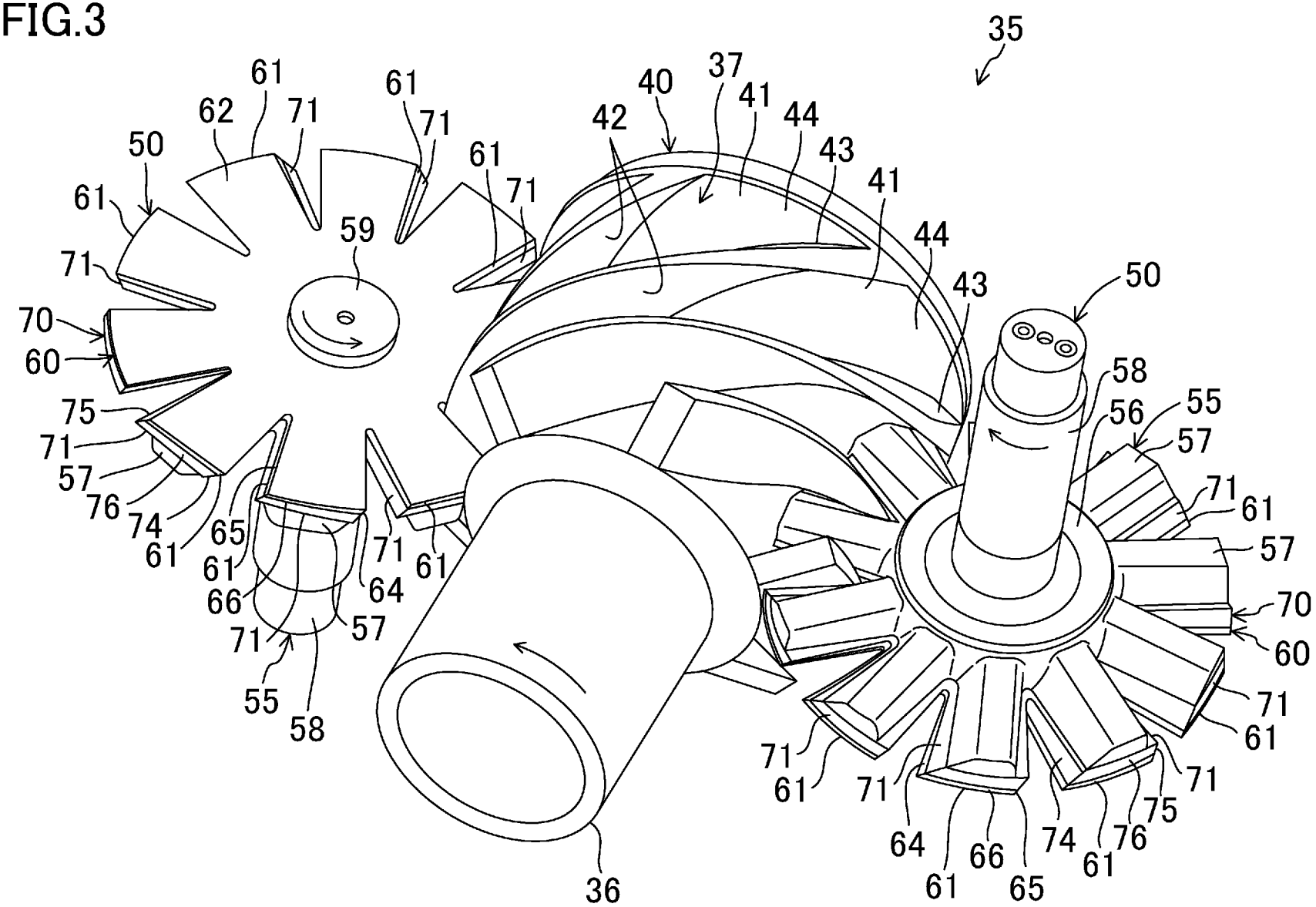
FIG. 3 is a perspective view illustrating a screw rotor and gate rotor assemblies meshing with each other.

As shown in FIG. 3, the screw rotor (40) is a metal member which is substantially in the shape of a cylindrical column. The screw rotor (40) is rotatably fitted in the cylinder portion (20), and an outer peripheral surface thereof is in sliding contact with the inner peripheral surface of the cylinder portion (20).

A plurality of helical grooves (41) is formed in an outer periphery of the screw rotor (40). Each of the helical grooves (41) is a recessed groove that opens at the outer peripheral surface of the screw rotor (40), and helically extends from one end of the screw rotor (40) to the other. Each of the helical grooves (41) of the screw rotor (40) has a starting end toward the low pressure space (15), and a terminal end toward the high pressure space (16).

Each of the helical grooves (41) which opens at the outer peripheral surface of the screw rotor (40) is defined by a single bottom wall surface (44) and a pair of sidewall surfaces facing each other. One of the pair of sidewall surfaces of the helical groove (41) on the front side in a direction of rotation of the screw rotor (40) is a front sidewall surface (42), while the other sidewall surface on the rear side in the direction of rotation of the screw rotor (40) is a rear sidewall surface (43).

As will be described in detail later, each of the gate rotor assemblies (50) includes a first gate rotor (60), a second gate rotor (70), and a rotor support member (55). Each of the gate rotors (60, 70) is a plate-like member having a plurality of (11 in this embodiment) gates (61, 71) arranged in a radial fashion. Each gate rotor (60, 70) is made of a hard resin. The first gate rotor (60) and the second gate rotor (70), overlapping one another, are attached to the rotor support member (55) made of metal.

In the casing (10), gate rotor chambers (17) are respectively formed on the left and right sides of the cylinder portion (20) in FIG. 2. The gate rotor assemblies (50) are respectively housed in the gate rotor chambers (17). Each of the gate rotor chambers (17) communicates with the low pressure space (15).

Specifically, a bearing housing (26) is provided in each of the gate rotor chambers (17). The bearing housing (26) is a metallic member which is generally cylindrical, and is fixed to the body (11) of the casing (10). Each of the gate rotor assemblies (50) has a shaft (58), which will be described later, rotatably supported by the bearing housing (26) via a ball bearing (27).

The gate rotor assemblies (50) are arranged to penetrate the cylinder portion (20). Each of the gate rotor assemblies (50) meshes with the screw rotor (40) so that the gates (61, 71) of the gate rotors (60, 70) enter the helical grooves (41) of the screw rotor (40). A wall surface of the cylinder portion (20) of the casing (10) through which the gate rotor assembly (50) penetrates constitutes a lateral sealing surface (21) that faces a front surface of the first gate rotor (60). The lateral sealing surface (21) is a flat surface extending in an axial direction of the screw rotor (40) along the outer periphery of the screw rotor (40), and is in sliding contact with the front surface of the first gate rotor (60).

In the compression mechanism (35), a space surrounded by the inner peripheral surface of the cylinder portion (20), the helical groove (41) of the screw rotor (40), and the gate (61, 71) of the gate rotor (60, 70) serves as a compression chamber (37). When the screw rotor (40) rotates, the gate (61, 71) of the gate rotor (60, 70) relatively moves from the starting end to terminal end of an associated one of the helical grooves (41), which changes the volume of the compression chamber (37) to compress the refrigerant in the compression chamber (37).

As shown in FIG. 2, a slide valve (90) for capacity regulation is provided for each of the gate rotors of the screw compressor (1). Specifically, the screw compressor (1) is provided with the same number of slide valves (90) as the gate rotors (two in this embodiment).

The slide valves (90) are attached to the cylinder portion (20). The cylinder portion (20) has a hollow (22) extending in its axial direction. The slide valve (90) is arranged so that a valve body (91) thereof fits in the hollow (22) of the cylinder portion (20), and that a front surface of the valve body (91) faces a peripheral surface of the screw rotor (40). The slide valve (90) is slidable in the axial direction of the cylinder portion (20). In addition, a portion of the hollow (22) of the cylinder portion (20) closer to the bearing holder (24) than the valve body (91) of the slide valve (90) serves as a discharge port through which the compressed refrigerant is delivered out of the compression chamber (37).

Although not shown, a rod of a slide valve drive mechanism (95) is connected to each of the slide valves (90). The slide valve drive mechanism (95) is a mechanism for driving each of the slide valves (90) so that the slide valve (90) moves in the axial direction of the cylinder portion (20). Each slide valve (90) is driven by the slide valve drive mechanism (95), and reciprocates in the axial direction of the slide valve (90).

—Gate Rotor Assembly—

As described above, each of the gate rotor assemblies (50) includes the first gate rotor (60), the second gate rotor (70), and the rotor support member (55). The configuration of the gate rotor assembly (50) will be described in detail below.

Figure 4:
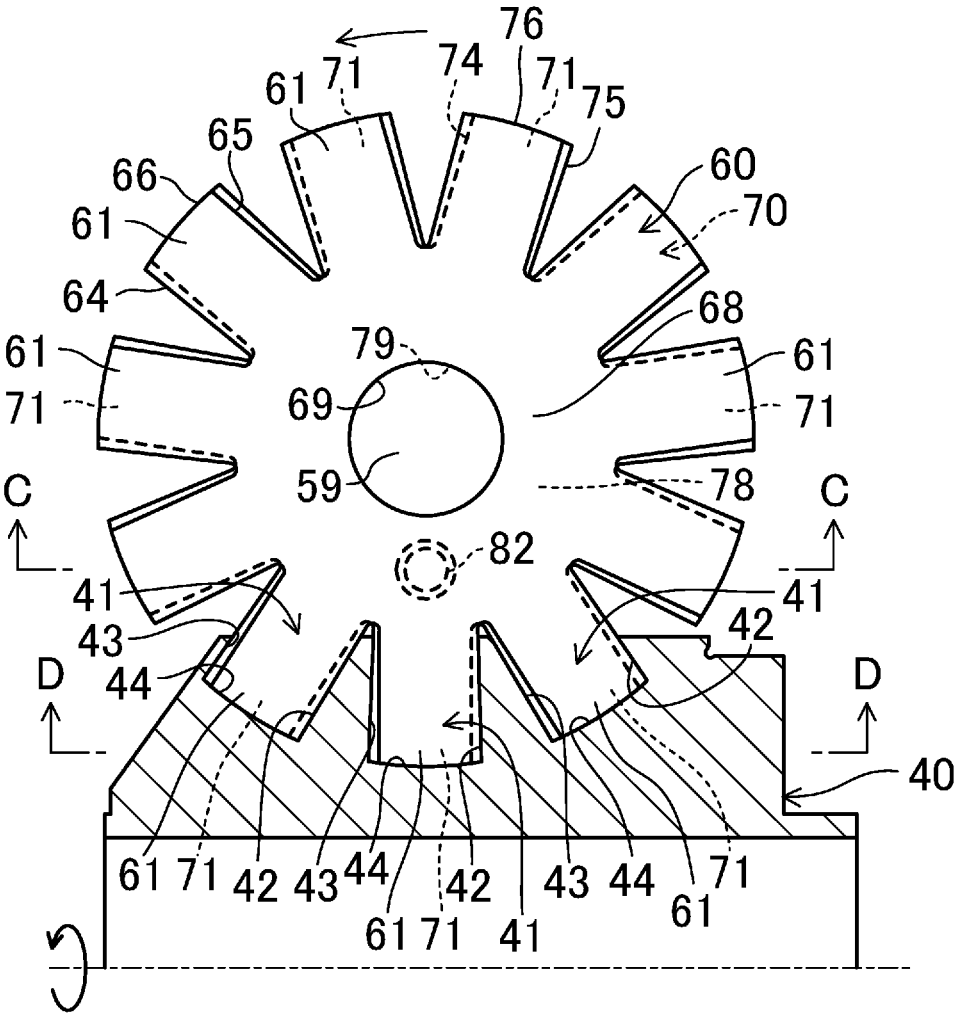
FIG. 4 is a cross-sectional view taken along line B-B in FIG. 2, illustrating the screw rotor and one of the gate rotor assemblies.

As shown in FIGS. 3 and 4, each of the gate rotors (60, 70) is a resin member which is generally in the shape of a disk. Each of the gate rotors (60, 70) is provided with a center hole (69, 79) which is a round through hole coaxial with the center axis of the gate rotor. Each of the gate rotors (60, 70) includes a round base (68, 78) having the center hole (69, 79) formed therein, and a plurality of (11 in this embodiment) gates (61, 71) each of which is generally in a rectangular shape. The gates (61, 71) of each gate rotor (60, 70) extend radially outward from the outer periphery of the base (68, 78), and are arranged at equiangular intervals in a circumferential direction of the base (68, 78). The gates (61) of the first gate rotor (60) and the gates (71) of the second gate rotor (70) are different in shape. The shapes of the gates (61, 71) of the gate rotors (60, 70) will be described in detail later.

Figure 5:
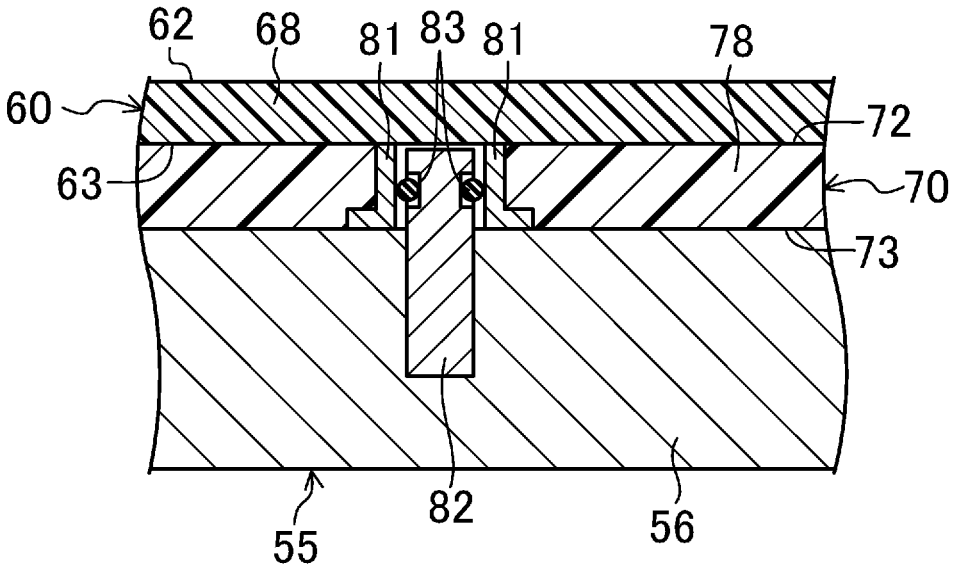
FIG. 5 is a cross-sectional view taken along line C-C in FIG. 4, illustrating a principal part of the gate rotor assembly.
Figure 6:
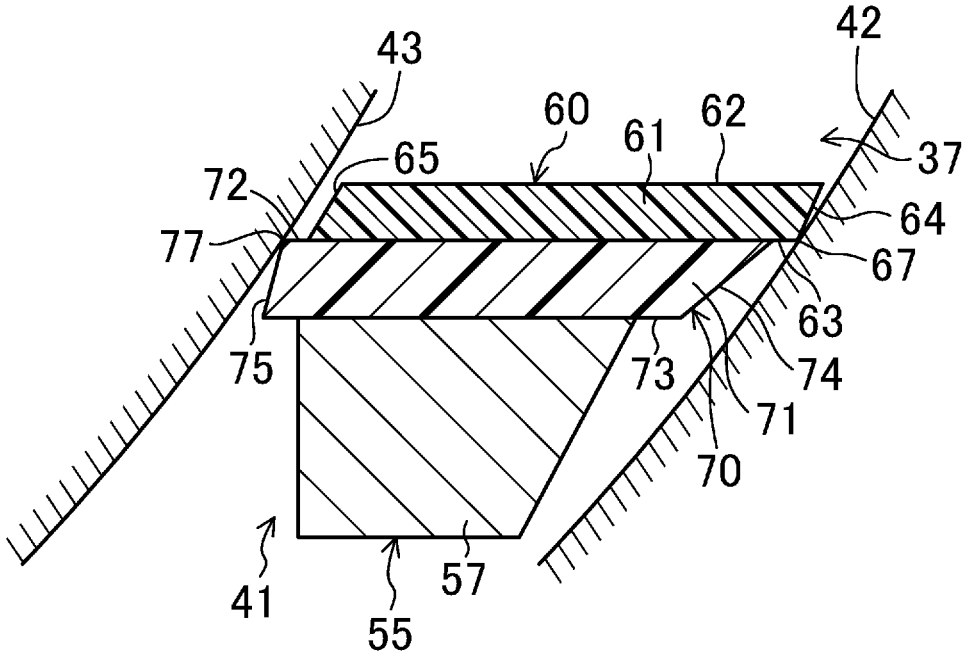
FIG. 6 is a cross-sectional view taken along line D-D in FIG. 4, illustrating a principal part of the gate rotor assembly and the screw rotor.

As shown in FIGS. 5 and 6, the first gate rotor (60) is thinner than the second gate rotor (70). Specifically, the first gate rotor (60) has a thickness of about 1 mm to 2 mm, and the second gate rotor (70) has a thickness of about 6 mm to 7 mm. The thicknesses of the gate rotors (60, 70) are merely an example.

As shown in FIGS. 2 and 3, the rotor support member (55) includes a disk portion (56), gate supports (57), a shaft (58), and a center protrusion (59). The disk portion (56) is in the shape of a somewhat thick disk. The gate supports (57) are provided only in the same number (11 in this embodiment) as the gates (61, 71) of the gate rotor (60, 70), and extend radially outward from the outer periphery of the disk portion (56). The gate supports (57) are arranged at equiangular intervals in the circumferential direction of the disk portion (56). The shaft (58) is in a circular rod shape and stands upright on the disk portion (56). The shaft (58) has a center axis which coincides with the center axis of the disk portion (56). The center protrusion (59) is provided on a surface of the disk portion (56) opposite to the shaft (58). The center protrusion (59) is in the shape of a short cylindrical column, and is arranged coaxially with the disk portion (56). An outer diameter of the center protrusion (59) is substantially equal to an inner diameter of the center hole (69, 79) of the gate rotor (60, 70).

The first gate rotor (60) and the second gate rotor (70) are attached to the rotor support member (55) to overlap one another. In the gate rotor assembly (50), the second gate rotor (70) is disposed toward the gate support (57), and the first gate rotor (60) is disposed on the side of the second gate rotor (70) opposite to the gate support (57). In each of the gate rotors (60, 70), the center protrusion (59) of the rotor support member (55) is fitted in the center hole (69, 79). The center protrusion (59) fitted into the center hole (69, 79) of each of the gate rotors (60, 70) makes the rotor support member (55) substantially unable to move in the radial direction.

In the gate rotor assembly (50), the first gate rotor (60) and the second gate rotor (70) overlap one another such that a back surface (73) of the second gate rotor (70) is in contact with a front surface of the gate support (57), and a back surface (63) of the first gate rotor (60) is in contact with a front surface (72) of the second gate rotor (70). On the back surface (73) of the second gate rotor (70), the gate supports (57) of the rotor support member (55) are arranged on the gates (71) on a one-by-one basis. Each of the gate supports (57) supports an associated one of the gates (71) of the second gate rotor (70) from the back surface (73). On the front surface (72) of the second gate rotor (70), the gates (61) of the first gate rotor (60) are arranged on the gates (71) on a one-by-one basis. Each of the gates (61) of the first gate rotor (60) is supported by the gate support (57) through an associated one of the gates (71) of the second gate rotor (70).

As shown in FIGS. 4 and 5, the second gate rotor (70) is fixed to the rotor support member (55) via a fixing pin (82). The fixing pin (82) has a base end which is embedded in the disk portion (56) of the rotor support member (55). A tip end of the fixing pin (82) protrudes from the front surface of the disk portion (56). Further, a circumferential groove is formed in an outer peripheral surface of the tip end of the fixing pin (82), into which an O-ring (83) is fitted. The second gate rotor (70) is provided with a through hole formed on the side of the center hole (79) of the base (78), in which a cylindrical metal sleeve (81) is fitted.

The tip end of the fixing pin (82) fitted in the sleeve (81) causes the second gate rotor (70) to be fixed to the rotor support member (55). The O-ring (83) attached to the fixing pin (82) is in contact with an inner peripheral surface of the sleeve (81). The sleeve (81) making contact with the O-ring (83) of the fixing pin (82) restricts the displacement of the second gate rotor (70) in the circumferential direction of the rotor support member (55). However, since the O-ring (83) is elastically deformed, the second gate rotor (70) is slightly movable in the circumferential direction of the rotor support member (55). Specifically, the second gate rotor (70) is restricted from moving in both of the radial and circumferential directions of the rotor support member (55).

On the other hand, the first gate rotor (60) has the center hole (69) in which the center protrusion (59) of the rotor support member (55) is fitted, but does not engage with the fixing pin (82). Thus, the first gate rotor (60) is restricted from moving in the radial direction of the rotor support member (55), but is movable in the radial direction of the rotor support member (55).

Note that the gate rotor assembly (50) meshes with the screw rotor (40), and some of the gates (61, 71) of each gate rotor (60, 70) have entered the corresponding helical grooves (41) of the screw rotor (40). Therefore, the first gate rotor (60) is restricted from moving in the circumferential direction of the first gate rotor (60) by the gates (61) that have entered the helical grooves (41).

<Details of Shape of Gate>

Details of the shape of the gate (61, 71) of each gate rotor (60, 70) will be described below.

As shown in FIGS. 3 and 6, each of the gates (61, 71) of the first and second gate rotors (60) and (70) has a front lateral face (64, 74) located on a front side in the direction of rotation of the gate rotor assembly (50), a rear lateral face (65, 75) located on a rear side in the direction of rotation of the gate rotor assembly (50), and a tip end face (66, 76) located at the outer periphery of the gate rotor (60, 70). The front surface (62, 72) and back surface (63, 73) of each of the gate rotors (60, 70) are flat surfaces which are substantially orthogonal to the center axis of the corresponding gate rotor (60, 70).

As shown in FIGS. 4 and 6, when the gate (61, 71) of each gate rotor (60, 70) enters an associated one of the helical grooves (41) of the screw rotor (40), the front lateral face (64, 74) faces the front sidewall surface (42) of the helical groove (41), the rear lateral face (65,75) faces the rear sidewall surface (43) of the helical groove (41), and the tip end face (66, 76) faces the bottom wall surface (44) of the helical groove (41).

As shown in FIG. 6, in each of the gates (61) of the first gate rotor (60), an edge of the front lateral face (64) toward the second gate rotor (70), i.e., an edge at the boundary between the front lateral face (64) and the back surface (63), serves as a front seal line (67). The front seal line (67) is a linear portion extending between the base end and tip end of the gate (61). The front seal line (67) of the gate (61) slides on the front sidewall surface (42) of the helical groove (41) while the gate (61) enters and comes out of the helical groove (41) of the screw rotor (40). The front lateral face (64) of the gate (61) of the first gate rotor (60) is inclined. Therefore, only the front seal line (67) of the front lateral face (64) of the gate (61) slides on the front sidewall surface (42) of the helical groove (41) while the gate (61) enters and comes out of the helical groove (41) of the screw rotor (40).

The rear lateral face (65) of the gate (61) of the first gate rotor (60) is inclined, and is always noncontact with the rear sidewall surface (43) of the helical groove (41) of the screw rotor (40). When the gate (61) of the first gate rotor (60) has entered the helical groove (41) of the screw rotor (40), a gap is formed between the rear lateral face (65) of the gate (61) and the rear sidewall surface (43) of the helical groove (41).

Although not shown, an edge of the tip end face (66) of the gate (61) of the first gate rotor (60) toward the second gate rotor (70), i.e., an edge at the boundary between the tip end face (66) and the back surface (63), serves as a tip end seal line. Only the tip end seal line of the tip end face (66) of the gate (61) slides on the bottom wall surface (44) of the helical groove (41) while the gate (61) enters and comes out of the helical groove (41) of the screw rotor (40).

As shown in FIG. 6, the front end face (74) of the gate (71) of the second gate rotor (70) is inclined, and is always noncontact with the front sidewall surface (42) of the helical groove (41) of the screw rotor (40). When the gate (71) of the second gate rotor (70) has entered the helical groove (41) of the screw rotor (40), a gap is formed between the front lateral face (74) of the gate (71) and the front sidewall surface (42) of the helical groove (41).

An edge of the rear lateral face (75) of the gate (71) of the second gate rotor (70) toward the first gate rotor (60), i.e., an edge at the boundary between the rear lateral face (75) and the front surface (72), serves as a rear seal line (77). The rear seal line (77) is a linear portion extending from the base end to tip end of the gate (71). The rear seal line (77) of the gate (71) slides on the rear sidewall surface (43) of the helical groove (41) while the gate (71) enters and comes out of the helical groove (41) of the screw rotor (40). The rear lateral face (75) of the gate (71) of the second gate rotor (70) is inclined. Therefore, only the rear seal line (77) of the rear lateral face (75) of the gate (71) slides on the rear sidewall surface (43) of the helical groove (41) while the gate (71) enters and comes out of the helical groove (40) of the screw rotor (40).

Although not shown, an edge of the tip end face (76) of the gate (61) of the second gate rotor (70) toward the first gate rotor (60), i.e., an edge at the boundary between the tip end face (76) and the front surface (72), serves as a tip end seal line. Only the tip end seal line of the tip end face (76) of the gate (71) slides on the bottom wall surface (44) of the helical groove (41) while the gate (71) enters and comes out of the helical groove (41) of the screw rotor (40).

As described above, the edge of the front lateral face (64) of the gate (61) of the first gate rotor (60) toward the second gate rotor (70) serves as the front seal line (67), and the edge of the rear lateral face (75) of the gate (71) of the second gate rotor (70) toward the first gate rotor (60) serves as the rear seal line (77). Accordingly, the front seal line (67) of each gate (61) of the first gate rotor (60) and the rear seal line (77) of each gate (71) of the second gate rotor (70) are on a single plane which is orthogonal to the center axis of the first and second gate rotors (60) and (70).

<Arrangement of Gate Rotor Assembly>

As shown in FIG. 2, the two gate rotor assemblies (50) are arranged in the casing (10) to be axially symmetric with respect to a rotation axis of the screw rotor (40). The rotation axis of each of the gate rotor assemblies (50) (i.e., the center axis of the rotor support member (55)) and the rotation axis of the screw rotor (40) substantially form a right angle.

Specifically, the gate rotor assembly (50) on the right of the screw rotor (40) in FIG. 2 is arranged with the shaft (58) of the rotor support member (55) extending upward. The gate rotor assembly (50) on the left of the screw rotor (40) shown in FIG. 2 is arranged with the shaft (58) of the rotor support member (55) extending downward. The front surface of the first gate rotor (60) of each gate rotor assembly (50) is in sliding contact with the lateral sealing surface (21) of the casing (10).

—Operation of Screw Compressor—

An operation of the screw compressor (1) will be described below.

When the electric motor (30) is energized, the screw rotor (40) is driven by the electric motor (30) to rotate. The gate rotor assemblies (50) are driven by the screw rotor (40) to rotate.

In the compression mechanism (35), the gate rotor assemblies (50) mesh with the screw rotor (40). When the screw rotor (40) and the gate rotor assemblies (50) rotate, the gate (61, 71) of the gate rotor (60, 70) relatively moves from the starting end to terminal end of an associated one of the helical grooves (41) of the screw rotor (40), which changes the volume of the compression chamber (37). As a result, in the compression mechanism (35), a suction phase in which a low pressure refrigerant is sucked into the compression chamber (37), a compression phase in which the refrigerant in the compression chamber (37) is compressed, and a discharge phase in which the compressed refrigerant is discharged from the compression chamber (37) are performed.

The low pressure gas refrigerant that has flowed from the evaporator is sucked into the low pressure space (15) in the casing (10) through the suction port (12). The refrigerant in the low pressure space (15) is sucked into the compression mechanism (35) to be compressed. The refrigerant compressed in the compression mechanism (35) flows into the high pressure space (16). Thereafter, the refrigerant passes through the oil separator (33), and is discharged outside the casing (10) through the discharge port (13). The high pressure gas refrigerant discharged from the discharge port (13) flows toward the condenser.

—Force Acting on Gate Rotor—

As described above, the gate rotor assemblies (50) are driven to rotate by the screw rotor (40). The force of the screw rotor (40) driving the gate rotor assemblies (50) acts on the second gate rotor (70). The pressure of the refrigerant in the casing (10) acts on each of the gate rotors (60, 70) of the gate rotor assemblies (50). The force acting on each of the gate rotors (60, 70) of the gate rotor assemblies (50) will be described below.

<Driving Force Acting on Gate Rotor Assembly>

As shown in FIG. 6, the gate (71) of the second gate rotor (70) of each of the gate rotor assemblies (50) slides on the rear sidewall surface (43) of an associated one of the helical grooves (41). Thus, the gate (71) of the second gate rotor (70) of the gate rotor assembly (50) which has entered the helical groove (41) is pushed by the screw rotor (40). As shown in FIG. 5, the second gate rotor (70) is fixed to the rotor support member (55) via the fixing pin (82). Therefore, the force of the screw rotor (40) pressing the second gate rotor (70) (i.e., the driving force) is transmitted to the rotor supporting member (55) via the fixing pin (82). This causes the entity of gate rotor assembly (50) to rotate.

<Refrigerant Pressure Acting on Second Gate Rotor>

As shown in FIG. 6, the edge of the front lateral face (64) of the gate (61) of the first gate rotor (60) toward the second gate rotor (70) serves as the front seal line (67), and the edge of the rear lateral face (75) of the gate (71) of the second gate rotor (70) toward the first gate rotor (60) serves as the rear seal line (77).

In FIG. 6, a portion of the helical groove (41) of the screw rotor (40) below the front seal line (67) and the rear seal line (77) (i.e., a portion toward the gate support (57)) communicates with the low pressure space (15) and the gate rotor chamber (17). Therefore, each of the gates (71) of the second gate rotor (70) receives the pressure of the low pressure space (15) (i.e., the pressure of the refrigerant present in the low pressure space (15)) on the entire front lateral face (74) and the entire rear lateral face (75).

For each of the gates (71) of the second gate rotor (70), the pressure of the refrigerant acts on the front lateral face (74) in a direction opposite to the direction of rotation of the gate rotor assembly (50), and on the rear lateral face (75) in the direction of rotation of the gate rotor assembly (50). Each of the gates (71) of the second gate rotor (70) has the front lateral face (74) and the rear lateral face (75) having a substantially equal length. Therefore, on each gate (71) of the second gate rotor (70), the force acting on the front lateral face (74) by the refrigerant pressure and the force acting on the rear lateral face (75) by the refrigerant pressure cancel each other out.

Therefore, on the second gate rotor (70), no force acts in the direction in which the rear seal line (77) of the gate (71) that has entered the helical groove (41) of the screw rotor (40) is separated away from the rear sidewall surface (43) of the helical groove (41). Therefore, a substantially zero clearance is maintained between the rear seal line (77) of the gate (71) of the second gate rotor (70) which has entered the helical groove (41) of the screw rotor (40) and the rear sidewall surface (43) of the helical groove (41). This ensures the gastightness of the compression chamber (37).

<Refrigerant Pressure Acting on First Gate Rotor>

In FIG. 6, a portion of the helical groove (41) of the screw rotor (40) above the front seal line (67) and the rear seal line (77) (a portion opposite to the gate support (57)) is the compression chamber (37) in which the refrigerant is compressed. Therefore, the gate (61) of the first gate rotor (60) that has entered the helical groove (41) of the screw rotor (40) receives the pressure of the compression chamber (37) (i.e., the pressure of the refrigerant present in the compression chamber (37)) on a portion of the front lateral face (64) and a portion of the rear lateral face (65) which are located inside the helical groove (41).

As shown in FIGS. 7A to 7D, in the compression mechanism (35) of the present embodiment, three of the gates (61) of the first gate rotor (60) face the compression chamber (37) during the compression phase or the discharge phase. Thus, the force that displaces the first gate rotor (60) in the circumferential direction becomes the resultant of forces (FA, FB, FC) acting on the three gates (61*a*, 61*b*, 61*c*). In each of FIGS. 7A to 7D, the first gate rotor (60) rotates in a counterclockwise direction.

First, the force acting on the first gate rotor (60) in the state shown in FIG. 7A will be described below.

Figure 7A:
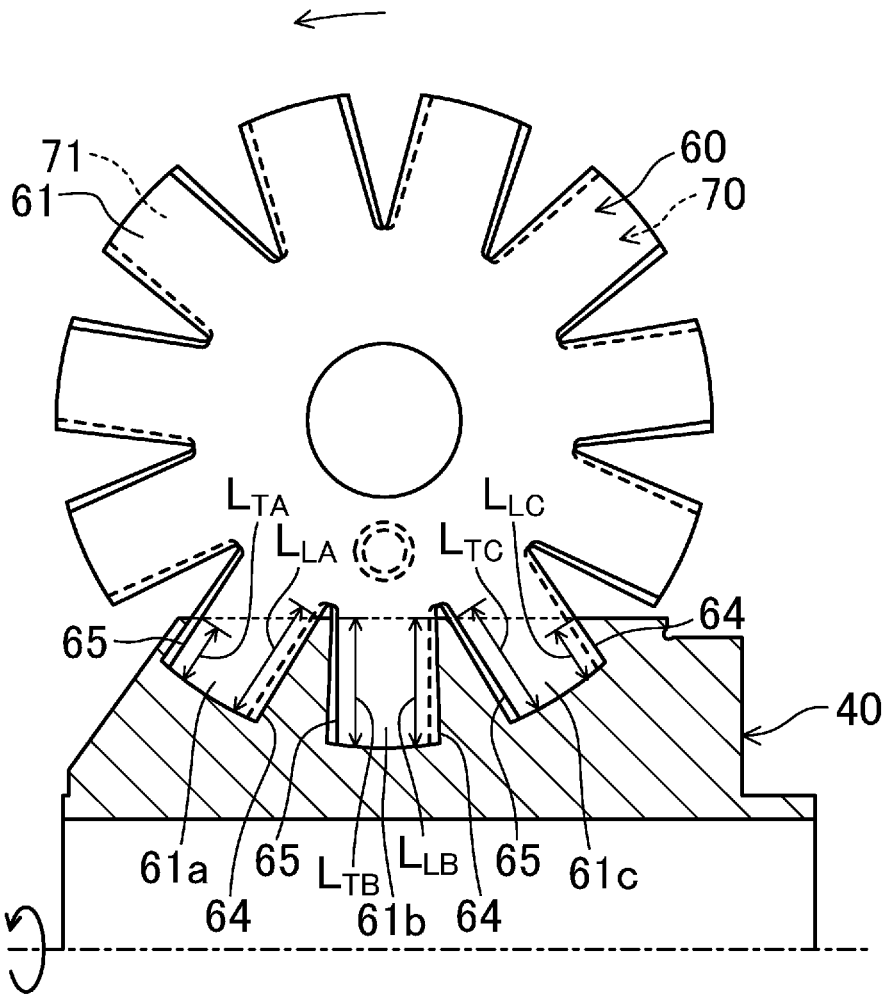
FIG. 7A is a cross-sectional view similar to FIG. 4.

As for the gate (61*a*), a region of the front lateral face (64) having a length LLA shown in FIG. 7A faces the front sidewall surface (42) of the helical groove (41), and a region of the rear lateral face (65) having a length LTA shown in FIG. 7A faces the rear sidewall surface (43) of the helical groove (41). The gate (61*a*) receives the pressure of the compression chamber (37) on the region of the front lateral face (64) having the length LLA and facing the front sidewall surface (42), and the region of the rear lateral face (65) having the length LTA and facing the rear sidewall surface (43). In the gate (61*a*) shown in FIG. 7A, the length LTA is shorter than the length LLA (LTA<LLA). Thus, the force FA derived from the pressure of the compression chamber (37) acts on the gate (61*a*) in such a direction that causes the first gate rotor (60) to rotate in the clockwise direction in FIG. 7A (FA<0).

As for the gate (61*b*), a region of the front lateral face (64) having a length LLB shown in FIG. 7A faces the front sidewall surface (42) of the helical groove (41), and a region of the rear lateral face (65) having a length LTB shown in FIG. 7A faces the rear sidewall surface (43) of the helical groove (41). The gate (61*b*) receives the refrigerant pressure of the compression chamber (37) on the region of the front lateral face (64) having the length LLB and facing the front sidewall surface (42), and the region of the rear lateral face (65) having the length LTB and facing the rear sidewall surface (43). In the gate (61*b*) shown in FIG. 7A, the length LLB is equal to the length LTB (LTA=LLA). Thus, the force FB derived from the pressure of the compression chamber (37) and acts on the gate (61*b*) is zero (FB=0).

As for the gate (61*c*), a region of the front lateral face (64) having a length LLC shown in FIG. 7A faces the front sidewall surface (42) of the helical groove (41), and a region of the rear lateral face (65) having a length LTC shown in FIG. 7A faces the rear sidewall surface (43) of the helical groove (41). The gate (61*c*) receives the pressure of the compression chamber (37) on the region of the front lateral face (64) having the length LLC and facing the front sidewall surface (42), and the region of the rear lateral face (65) having the length LTC and facing the rear sidewall surface (43). In the gate (61*c*) shown in FIG. 7A, the length LTC is greater than the length LLC (LLC<LTC). Thus, the force FC derived from the pressure of the compression chamber (37) acts on the gate (61*c*) in such a direction that causes the first gate rotor (60) to rotate in the counterclockwise direction in FIG. 7A (0<FC).

In FIG. 7A, the pressure of the compression chamber (37) which the gate (61) of the first gate rotor (60) faces gradually increases as the gate (61) moves in the counterclockwise direction. Thus, the pressure PC of the compression chamber (37) which the gate (61*c*) faces is higher than the pressure PA of the compression chamber (37) which the gate (61*a*) faces. Therefore, the magnitude of the force FC (an absolute value of the force FC) acting on the gate (61*c*) is larger than the magnitude of the force FA (an absolute value of the force FA) acting on the gate (61*a*) (|FA|<|FC|). Therefore, the force F (=FA+FB+FC) in the circumferential direction of the first gate rotor (60) acts on the first gate rotor (60) shown in FIG. 7A in such a direction that the first gate rotor (60) rotates in the counterclockwise direction (0<F).

Figure 7B:
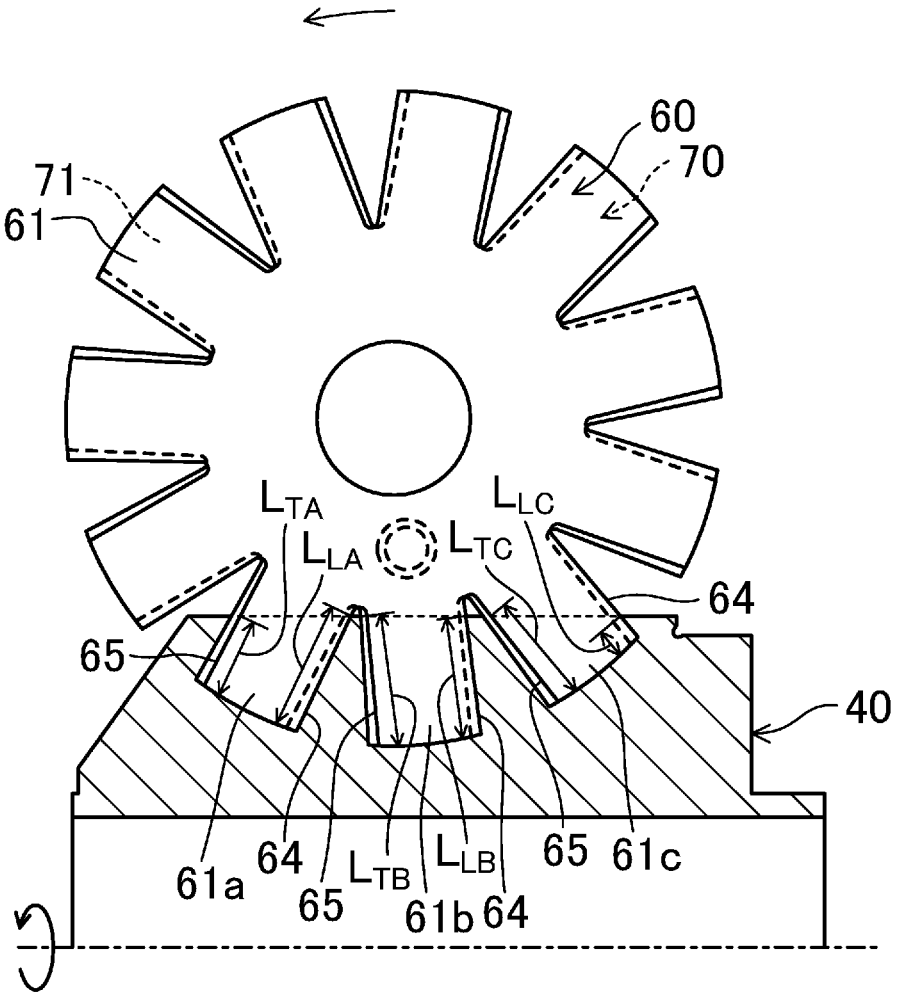
FIG. 7B is a cross-sectional view corresponding to FIG. 7A, illustrating the gate rotor assembly which has rotated counterclockwise from the position shown in FIG. 7A.

Next, the force acting on the first gate rotor (60) in the state shown in FIG. 7B will be described below. FIG. 7B shows the first gate rotor (60) that has rotated in the counterclockwise direction from the state shown in FIG. 7A.

As for the gate (61*a*), the front lateral face (64) faces the front sidewall surface (42) of the helical groove (41), and the rear lateral face (65) faces the rear sidewall surface (43) of the helical groove (41), just like in the state shown in FIG. 7A. Just like in the state shown in FIG. 7A, the length LTA of the gate (61*a*) is shorter than the length LLA (LTA<LLA). Thus, the force FA derived from the pressure of the compression chamber (37) acts on the gate (61*a*) in such a direction that causes the first gate rotor (60) to rotate in the clockwise direction in FIG. 7B (FA<0).

As for the gate (61*b*), the front lateral face (64) faces the front sidewall surface (42) of the helical groove (41), and the rear lateral face (65) faces the rear sidewall surface (43) of the helical groove (41), just like in the state shown in FIG. 7A. Unlike the state shown in FIG. 7A, the length LTB of the gate (61*b*) is greater than the length LLB (LLB<LTB). Thus, the force FB derived from the pressure of the compression chamber (37) acts on the gate (61*b*) in such a direction that causes the first gate rotor (60) to rotate in the counterclockwise direction in FIG. 7B (0<FB).

As for the gate (61*c*), the front lateral face (64) faces the front sidewall surface (42) of the helical groove (41), and the rear lateral face (65) faces the rear sidewall surface (43) of the helical groove (41), just like in the state shown in FIG. 7A. Just like in the state shown in FIG. 7A, the length LTC of the gate (61*c*) is greater than the length LLC (LLC<LTC). Thus, the force FC derived from the pressure of the compression chamber (37) acts on the gate (61*c*) in such a direction that causes the first gate rotor (60) to rotate in the counterclockwise direction in FIG. 7B (0<FC).

Just like in the state shown in FIG. 7A, the pressure of the compression chamber (37) which the gate (61) of the first gate rotor (60) faces gradually increases as the gate (61) moves in the counterclockwise direction. Thus, the pressure PC of the compression chamber (37) which the gate (61*c*) faces is higher than the pressure PB of the compression chamber (37) which the gate (61*b*) faces, and the pressure PB of the compression chamber (37) which the gate (61*b*) faces is higher than the pressure PA of the compression chamber (37) which the gate (61*a*) faces (PA<PB<PC).

The sum of the magnitude of the force FB (the absolute value of the force FB) acting on the gate (61*b*) and the magnitude of the force FC (the absolute value of the force FC) acting on the gate (61*c*) is greater than the magnitude of the force FA (the absolute value of the force FA) acting on the gate (61*a*) (|FA|<|FB+FC|). Therefore, the force F (=FA+FB+FC) in the circumferential direction of the first gate rotor (60) acts on the first gate rotor (60) shown in FIG. 7B in such a direction that causes the first gate rotor (60) to rotate in the counterclockwise direction (0<F).

Figure 7C:
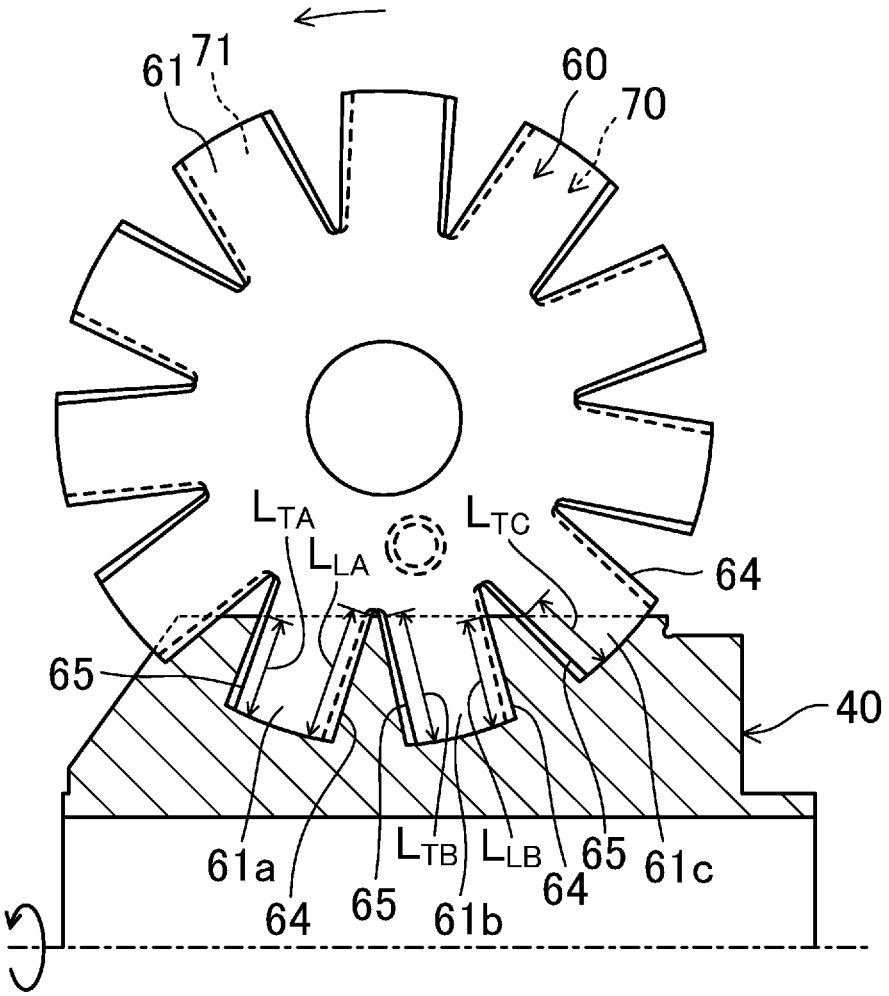
FIG. 7C is a cross-sectional view corresponding to FIG. 7B, illustrating the gate rotor assembly which has rotated counterclockwise from the position shown in FIG. 7B.
Figure 7D:
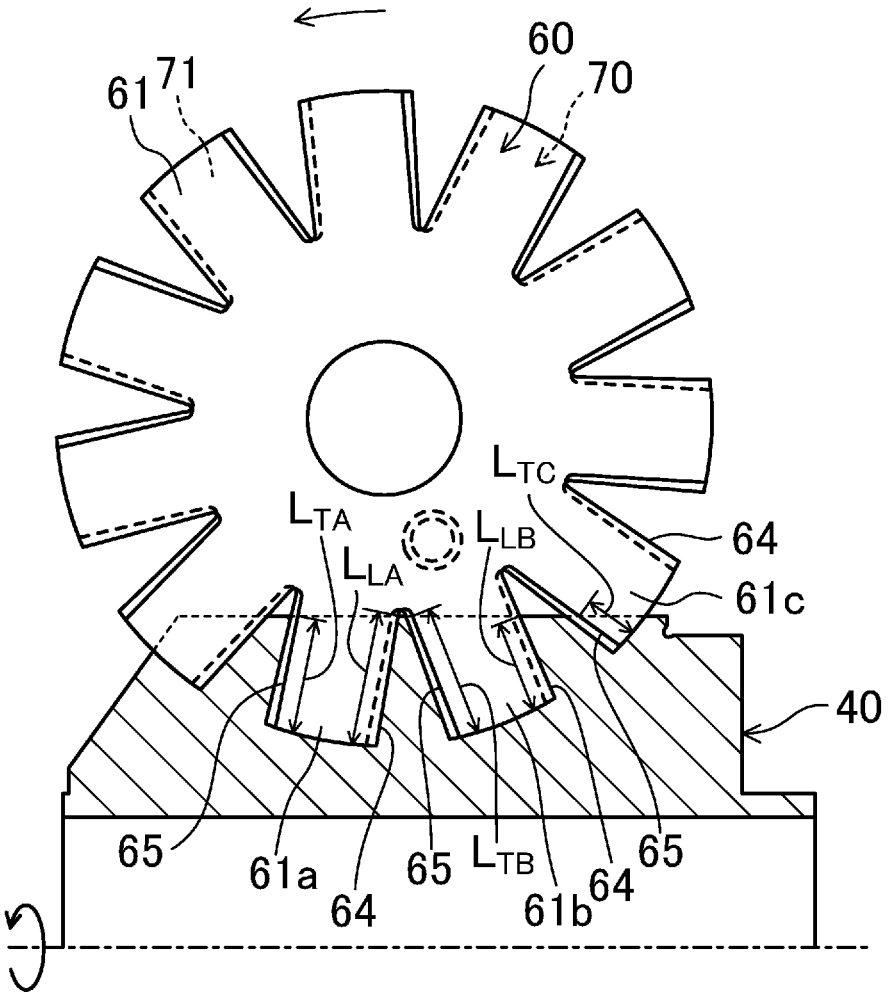
FIG. 7D is a cross-sectional view corresponding to FIG. 7C, illustrating the gate rotor assembly which has rotated counterclockwise from the position shown in FIG. 7C.

Next, the force acting on the first gate rotor (60) in the states shown in FIGS. 7C and 7D will be described below. FIG. 7C shows the first gate rotor (60) that has rotated in the counterclockwise direction from the state shown in FIG. 7B. FIG. 7D shows the first gate rotor (60) that has rotated in the counterclockwise direction from the state shown in FIG. 7C.

As for the gate (61*a*), the front lateral face (64) faces the front sidewall surface (42) of the helical groove (41), and the rear lateral face (65) faces the rear sidewall surface (43) of the helical groove (41), just like in the state shown in FIG. 7B. Just like in the state shown in FIG. 7B, the length LTA of the gate (61*a*) is shorter than the length LLA (LTA<LLA). Thus, the force FA derived from the pressure of the compression chamber (37) acts on the gate (61*a*) in such a direction that causes the first gate rotor (60) to rotate in the clockwise direction in FIGS. 7C and 7D (FA<0).

As for the gate (61*b*), the front lateral face (64) faces the front sidewall surface (42) of the helical groove (41), and the rear lateral face (65) faces the rear sidewall surface (43) of the helical groove (41), just like in the state shown in FIG. 7B. Just like in the state shown in FIG. 7B, the length LTB of the gate (61*b*) is greater than the length LLB (LLB<LTB). Thus, the force FB derived from the pressure of the compression chamber (37) acts on the gate (61*b*) in such a direction that causes the first gate rotor (60) to rotate in the counterclockwise direction in FIGS. 7C and 7D (0<FB).

As for the gate (61*c*), the front lateral face (64) does not face the front sidewall surface (42) of the helical groove (41), while the rear lateral face (65) faces the rear sidewall surface (43) of the helical groove (41), unlike the state shown in FIG. 7B. That is, the pressure of the compression chamber (37) which the gate (61*c*) faces acts on the rear lateral face (65) of the gate (61*c*), but does not act on the front lateral face (64) of the gate (61*c*). Thus, the force FC derived from the pressure of the compression chamber (37) acts on the gate (61*c*) in such a direction that causes the first gate rotor (60) to rotate in the counterclockwise direction in FIGS. 7C and 7D (0<FC).

Just like in the state shown in FIG. 7B, the pressure PC of the compression chamber (37) which the gate (61*c*) faces is higher than the pressure PB of the compression chamber (37) which the gate (61*b*) faces, and the pressure PB of the compression chamber (37) which the gate (61*b*) faces is higher than the pressure PA of the compression chamber (37) which the gate (61*a*) faces (PA<PB<PC).

The sum of the magnitude of the force FB (the absolute value of the force FB) acting on the gate (61*b*) and the magnitude of the force FC (the absolute value of the force FC) acting on the gate (61*c*) is greater than the magnitude of the force FA (the absolute value of the force FA) acting on the gate (61*a*) (|FA|<|FB+FC|). Therefore, the force F (=FA+FB+FC) acting on the first gate rotor (60) shown in FIGS. 7C and 7D acts in such a direction that causes the first gate rotor (60) to rotate in the counterclockwise direction (0<F).

In this manner, during the operation of the single-screw compressor (1), the first gate rotor (60) always receives the force that causes the first gate rotor (60) to rotate in the same direction as the rotation direction of the gate rotor assembly (50). Therefore, the pressure of the compression chamber (37) pushes the gate (61) of the first gate rotor (60) that has entered the helical groove (41) of the screw rotor (40) toward the front sidewall surface (42) of the helical groove (41), thereby maintaining a substantially zero clearance between the front seal line (67) and the front sidewall surface (42) of the helical groove (41). This ensures the gastightness of the compression chamber (37).

—First Advantage of Embodiments—

During the operation of the single-screw compressor, the temperature of the gate rotor increases to cause the gate rotor to thermally expand, which increases the width of the gate. If the width of the gate of the conventional single-screw compressor increases, the gate is strongly pressed against the wall surface of the helical groove of the screw rotor, which may possibly cause sudden wear of the gate.

In contrast, the single-screw compressor (1) of this embodiment includes the two gate rotors (60, 70) for the gate rotor assembly (50). The gate rotor assembly (50) is configured such that the first gate rotor (60) having the gates (61) each of which is provided with the front seal line (67) and the second gate rotor (70) having the gates (71) each of which is provided with the rear seal line (77) are relatively displaceable in the circumferential direction.

Thus, in the screw compressor (1) of this embodiment, even when the gate rotors (60, 70) thermally expand and the width of the gates (61, 71) increases, the two gate rotors (60, 70) are relatively displaced, so that the distance from the front seal line (67) to the rear seal line (77) is kept constant. If the distance from the front seal line (67) to the rear seal line (77) is constant, the force that the gate (61, 71) receives from the sidewall surfaces (42, 43) of the helical groove (41) of the screw rotor (40) does not substantially change.

Therefore, even when the gate (61, 71) thermally expands, this embodiment can keep the force that the gate (61) receives from the sidewall surfaces (42, 43) of the helical groove (41) of the screw rotor (40) from increasing, and can reduce the wear of the gate (61, 71) due to the thermal expansion. Further, this embodiment can keep the performance of the screw compressor (1) from decreasing due to the wear of the gate (61, 71).

—Second Advantage of Embodiments—

A single-screw compressor includes a screw rotor which is generally made of metal, and a gate rotor which is generally made of a resin. Therefore, it is impossible for the single-screw compressor to completely prevent the wear of the gate of the gate rotor. When the gate of the gate rotor is worn, the clearance between the gate and the wall surface of the helical groove of the screw rotor increases, and the amount of the refrigerant leaking from the compression chamber increases. As a result, the performance of the single-screw compressor decreases.

In contrast, the gate rotor assembly (50) of this embodiment is configured such that the first gate rotor (60) having the gates (61) each of which is provided with the front seal line (67) and the second gate rotor (70) having the gates (71) each of which is provided with the rear seal line (77) are relatively displaceable in the circumferential direction. In addition, in the single-screw compressor (1) of this embodiment, the gate (61) of the first gate rotor (60) is pressed toward the front sidewall surface (42) of the helical groove (41) of the screw rotor (40) by the pressure of the compression chamber (37).

Therefore, even when the gate (61, 71) of the gate rotor (60, 70) is worn to narrow the gate (61, 71), the displacement of the first gate rotor (60) in the circumferential direction can keep the distance from the front seal line (67) to the rear seal line (77) constant. If the distance from the front seal line (67) to the rear seal line (77) is constant, the clearance between the sidewall surface (42, 43) of the helical groove (41) of the screw rotor (40) and the gate (61, 71) is substantially kept constant.

Therefore, according to the present embodiment, even when the gate (61, 71) of the gate rotor (60, 70) is worn, the clearance between the gate (61, 71) and the sidewall surface (42,43) of the helical groove (41) of the screw rotor (40) can be kept constant, so that the gastightness of the compression chamber (37) can be kept high. As a result, the performance of the screw compressor (1) can be kept high for a long time.

—Third Advantage of Embodiments—

In this embodiment, the rear seal line (77), which is the edge of the rear lateral face (75) of the gate (71) of the second gate rotor (70) toward the first gate rotor (60), slides on the rear sidewall surface (43) of the helical groove (41) of the screw rotor (40). Each of the gates (71) of the second gate rotor (70) receives the pressure of the low pressure space (15) on the entire front lateral face (74) and the entire rear lateral face (75).

Thus, on the gate (71) of the second gate rotor (70) which has entered the helical groove (41) of the screw rotor (40), the refrigerant pressure acting on the rear lateral face (75) of the helical groove (41) (i.e., the pressure acting in the direction in which the gate (71) is separated away from the rear sidewall surface (43) of the helical groove (41)) is canceled by the refrigerant pressure acting on the front lateral face (74) of the helical groove (41). Therefore, according to the present embodiment, the gate (71) of the second gate rotor (70) which has entered the helical groove (41) of the screw rotor (40) can slide on the rear sidewall surface (43) of the helical groove (41) with reliability. This can ensure the gastightness of the compression chamber (37).

—Fourth Advantage of Embodiments—

In this embodiment, the front seal line (67) of the gate (61) of the first gate rotor (60) and the rear seal line (77) of the gate (71) of the second gate rotor (70) are substantially on a single plane orthogonal to the center axis of the gate rotor (60, 70). Therefore, according to this embodiment, the screw rotor (40) provided with the helical grooves (41) of the same shape as those of the conventional screw rotor can be used. This can reduce the increase in the manufacturing cost of the single-screw compressor (1).

—Fifth Advantage of Embodiments—

As shown in FIG. 6, a gap is formed between the gate (61) of the first gate rotor (60) which has entered the helical groove (41) of the screw rotor (40) and the rear sidewall surface (43) of the helical groove (41). This gap communicates with the compression chamber (37), and serves as a passage which allows the compression chamber (37) to communicate with the gate rotor chamber (17). Thus, if the gap is large, the amount of fluid leaking from the compression chamber (37) through this gap increases, which may lead to the decrease in the performance of the single-screw compressor (1).

In contrast, in the gate rotor assembly (50) of the present embodiment, the first gate rotor (60) is made thinner than the second gate rotor (70). The thinner the first gate rotor (60) is, the narrower the gap formed between the rear lateral face (65) of the gate (61) of the first gate rotor (60) and the rear sidewall surface (43) of the helical groove (41) becomes. Therefore, when the first gate rotor (60) is made thinner than the second gate rotor (70), the amount of fluid leaking from the compression chamber (37) can be reduced, and the performance of the single-screw compressor (1) can be kept high.

—Variation of Embodiment—

Figure 8:
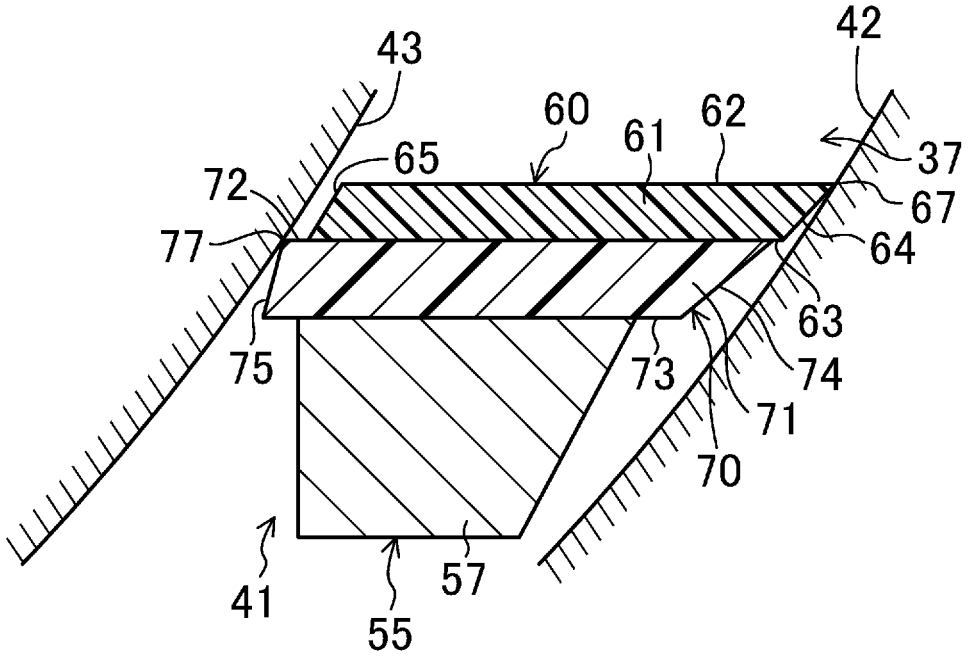
FIG. 8 is a cross-sectional view corresponding to FIG. 6, illustrating a variation of the single-screw compressor of the embodiment.

As shown in FIG. 8, in the gate rotor assembly (50) of the present embodiment, an edge of the front lateral face (64) of the gate (61) of the first gate rotor (60) toward the compression chamber (37), i.e., an edge at the boundary between the front lateral face (64) and the front surface (62), may serve as the front seal line (67).

In this variation, the gate (61) of the first gate rotor (60) which has entered the helical groove (41) of the screw rotor (40) receives the internal pressure of the compression chamber (37) on the rear lateral face (65), and receives the pressure of the low pressure space (15) (i.e., the pressure of the refrigerant present in the low pressure space (15)) on the front lateral face (64). Therefore, a force that presses the gate (61) of the first gate rotor (60) of this variation toward the front sidewall surface (42) of the helical groove (41) of the screw rotor (40) is larger than that acted in the state shown in FIG. 6.

As can be seen in the foregoing, the present invention is useful for a single-screw compressor.

What is claimed is:

1. A single-screw compressor comprising:

a screw rotor provided with helical grooves;

a gate rotor assembly meshing with the screw rotor; and a casing housing the screw rotor and the gate rotor assembly, the gate rotor assembly including a first gate rotor and a second gate rotor each having a plurality of gates, each of the gates entering an associated one of the helical grooves of the screw rotor to form a compression chamber, and a rotor support member attached to the first gate rotor and the second gate rotor, and the rotor support member being rotatably supported by the casing, each of the helical grooves of the screw rotor having a front sidewall surface on a front side in a direction of rotation of the screw rotor, and a rear sidewall surface on a rear side in the direction of rotation of the screw rotor, each of the gates of the first gate rotor sliding only on the front sidewall surface, of the front sidewall surface and rear sidewall surface of the associated one of the helical grooves in which the gate has entered, each of the gates of the second gate rotor sliding only on the rear sidewall surface, of the front sidewall surface and rear sidewall surface of the helical groove in which the gate has entered, and the first gate rotor and second gate rotor of the gate rotor assembly being coaxially arranged and relatively displaceable in a circumferential direction.

2. The single-screw compressor of claim 1, wherein the first gate rotor and second gate rotor of the gate rotor assembly overlap one another such that a front surface of the first gate rotor faces the compression chamber, and the second gate rotor is located closer to a back surface of the second gate rotor.

3. The single-screw compressor of claim 2, wherein each of the gates of the second gate rotor has a lateral face facing the rear sidewall surface of the helical groove, and an edge of the lateral face toward the first gate rotor serves as a rear seal line, the rear seal line is a linear portion extending in a radial direction of the second gate rotor, and the edge of the lateral face toward the first gate rotor slides on the rear sidewall surface.

4. The single-screw compressor of claim 3, wherein each of the gates of the first gate rotor has a lateral face facing the front sidewall surface of the helical groove, and an edge of the lateral face toward the second gate rotor serves as a front seal line, the front seal line is a linear portion extending in a radial direction of the first gate rotor, and the edge of the lateral face toward the second gate rotor slides on the front sidewall surface.

5. The single-screw compressor of claim 4, wherein the first gate rotor is thinner than the second gate rotor.

6. The single-screw compressor of claim 3, wherein the first gate rotor is thinner than the second gate rotor.

7. The single-screw compressor of claim 2, wherein each of the gates of the first gate rotor has a lateral face facing the front sidewall surface of the helical groove, and an edge of the lateral face toward the second gate rotor serves as a front seal line, the front seal line is a linear portion extending in a radial direction of the first gate rotor, and the edge of the lateral face toward the second gate rotor slides on the front sidewall surface.

8. The single-screw compressor of claim 7, wherein the first gate rotor is thinner than the second gate rotor.

9. The single-screw compressor of claim 2, wherein the first gate rotor is thinner than the second gate rotor.

* * * * *